United States Patent [19]

Azzara

[11] Patent Number: 4,525,942

[45] Date of Patent: Jul. 2, 1985

[54] IRONING BOARD ATTACHMENT

[76] Inventor: Frank Azzara, 116 Riegelman St., Staten Island, N.Y. 11303

[21] Appl. No.: 568,750

[22] Filed: Jan. 6, 1984

[51] Int. Cl.[3] ..... D06F 79/00

[52] U.S. Cl. ..... 38/106; 38/107; 211/86

[58] Field of Search ..... 108/149, 29, 6; 248/117.1, 309.1, 231.8, 102, 103, 205; 24/274 WB; 211/116, 86; 38/106, 107, 108, 142

[56] References Cited

U.S. PATENT DOCUMENTS

| | | | |
|---|---|---|---|
| 1,016,848 | 2/1912 | North | 38/106 |
| 1,191,782 | 7/1916 | Harrison | 38/106 |
| 1,301,886 | 4/1919 | Tocknell | 248/102 |
| 2,472,244 | 6/1949 | Brady | 248/117.1 X |
| 2,730,612 | 1/1956 | Westendorf | 24/20.5 X |
| 3,435,957 | 4/1969 | Lloyd | 38/106 X |
| 4,113,218 | 9/1978 | Linder | 211/86 X |
| 4,154,010 | 5/1979 | Evans | 38/106 |

FOREIGN PATENT DOCUMENTS

| | | | |
|---|---|---|---|
| 187972 | 3/1905 | Fed. Rep. of Germany | 248/103 |
| 345392 | 3/1931 | United Kingdom | 38/107 |

*Primary Examiner*—Werner H. Schroeder
*Assistant Examiner*—Andrew M. Falik
*Attorney, Agent, or Firm*—Richard L. Miller

[57] ABSTRACT

An ironing rail attachment for an ironing board which allows the user to store ironing aides in a safe, convenient manner, without wasting space upon the ironing surface of the board. The rail also pivotably supports an iron stand to store the hot iron when not ironing articles. Provision is made to suspend ironed articles from hangers attached to the rail to avoid wasted energy and time. The ironing rail folds over for easy storage.

5 Claims, 6 Drawing Figures

Fig. 1
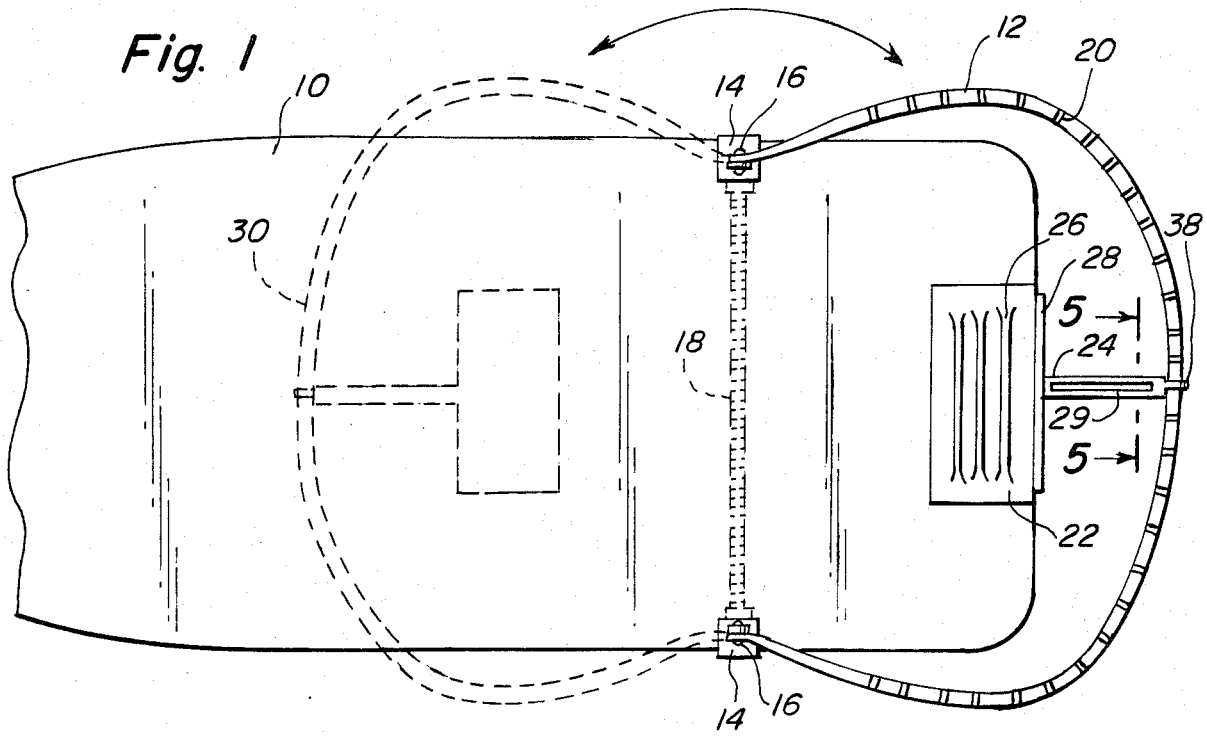
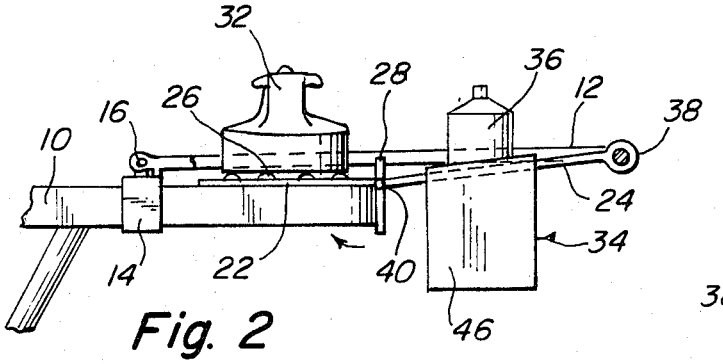
Fig. 2
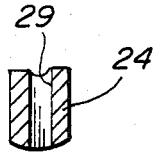
Fig. 5
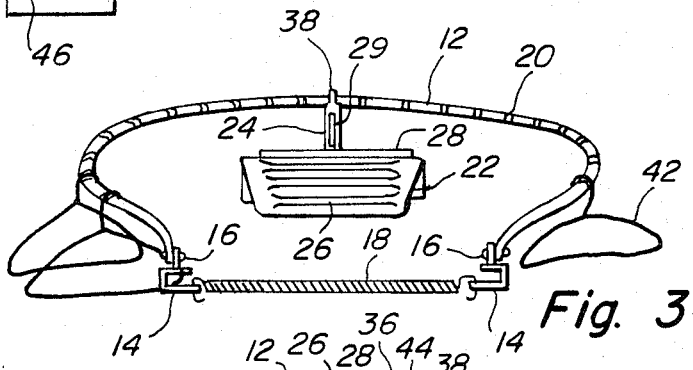
Fig. 3
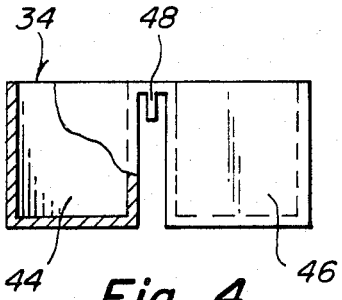
Fig. 4
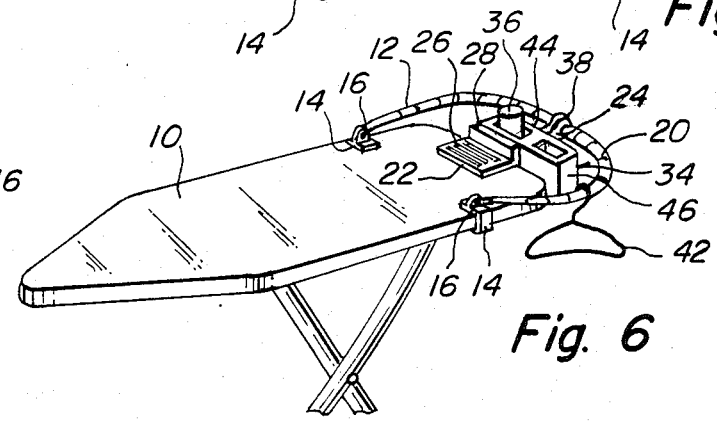
Fig. 6

IRONING BOARD ATTACHMENT

BACKGROUND OF THE INVENTION

This invention relates generally to attachments to ironing boards. Heretofore, users of ironing boards have been faced with the necessity of either devoting space on top of the ironing board to storage of ancillary aids such as spray starch, stain remover or distilled water. The only alternative to this waste of valuable ironing board space has been to walk back and for the to another storage area. Additionally, containers placed upon the working surface of an ironing board have a tendency to either fall off the board or be burnt upon accidental contact with a hot iron. Another difficulty concerning the use of ironing boards is that each article which has been ironed must often be hung immediately to avoid re-wrinkling. This often necessitates the user wasting time and energy in walking back and forth to a clothes storage area such as a closet. Yet another difficulty rests in the placement of the hot iron upon the ironing board when some task other than actual ironing is being performed. Careless placement or accidental movement of the iron can result in scorched clothing, ironing board pad or ironing board.

SUMMARY OF THE INVENTION

It is therefore an object of the present invention to provide an ironing rail which may be attached to any conventional ironing board.

It is a further object to provide an associated basket which is supported by this rail and which may contain a multiplicity of compartments in order to hold a variety of ironing aids. This basket will hold all of the above mentioned aids in place firmly and will not take away from the ironing board active work surface.

A yet further object is to provide notches in the ironing rail which may be used to support hanging clothes as they are ironed in order to obviate the need to walk back and forth to a closet.

Another object is to provide an iron stand which prevents the iron from burning clothes, ironing board pad or ironing board. This will be accomplished by providing an iron stand with ridges to prevent sliding and prevent unnecessary heat loss to the stand. Also a barrier is provided to prevent the iron from falling off of the end of the board.

Yet another object is to provide for the attachment of the rail in such a way as to prevent the shifting of the rail with respect to the ironing board.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a partial view of an ironing board with the invention thereupon and basket removed.

FIG. 2 is a side view thereof with parts broken away and basket in place.

FIG. 3 is a perspective view of the invention by itself with the basket removed.

FIG. 4 is an end view of the basket partly in cross section.

FIG. 5 is an enlarged cross sectional view of the brace taken along 5—5 in FIG. 1.

FIG. 6 is a perspective view of an ironing board with the invention installed thereupon.

DETAILED DESCRIPTION OF THE PREFERRED EMBODIMENT

Referring now to the drawing in greater detail, FIG. 1 shows a conventional ironing board 10 with a rail 12 attached by means of two retaining brackets 14 via associated rail pivot 16. A coiled helical spring 18 biases brackets 14 to each other and to ironing board 10 and coiled helical spring 18 is kept away form the working surface of the ironing board by having it run underneath the ironing board 10. Rail 12 has hanger notches as represented by a sample notch at 20. An iron stand 22 is supported by ironing board 10 and rail 12 via brace 24. The iron stand 22 has ridges 26 to prevent the iron from sliding and to reduce unnecessary heat loss to the iron stand 22. The iron stand 22 is also equipped with a barrier 28 which prevents the iron from falling off the iron stand 22 and thereby the iron board 10. The brace 24 is equipped with a basket guide notch 29 whose purpose will be herein described. An alternative storage position for the invention is represented by the invention as depicted in dashed line 30.

FIG. 2 shows a typical iron 32 resting upon iron stand 22 with representative ridge 26 and the support surface of the stand in flush contact with the ironing surface and a perpendicular edge of said stand flush with an edge on the ironing board used. A basket 34 which contains a representative spray can 36 is supported by brace 24. The basket 34 sits "saddle style" across brace 24. Brace 24 is shown supported by brace-to-rail pivot 38 and brace-to-iron stand pivot 40.

FIG. 3 shows, in detail, the method of attachment of helical coiled spring 18 to each of the two retaining brackets 14. Clothes hangers, represented by hanger 42, are shown suspended from rail 12.

FIG. 4 shows a typical basket 34 with compartments 44 and 46. The position of the basket along brace 24 is determined by the position of basket locator detent 48 relative to the configuration of basket guide notch 29, as shown in the sectional view of FIG. 5.

FIG. 6 shows the instant invention assembled and ready for use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A support rail in combination with an ironing board comprising means for pivotally attaching said rail to the substantially perpendicular edges of the ironing board sides to extend across said board so that the rail can be swung from a storage position to a support position substantially parallel to the surface of the ironing board, a brace pivotally attached at a first end to an intermediate portion of said rail, and an iron support stand pivotally attached to a second end of said brace wherein when said rail is in said support position said stand is located between an ironing board end edge and said rail intermediate portion such that an iron support surface on said stand is flush with said ironing board surface and an end surface on said stand which is substantially perpendicular to said iron support surface is flush with said ironing board end edge.

2. The support rail and ironing board combination as recited in claim 1 wherein a basket is attached to said brace and said brace is notched in order to engage a basket locator detent located on said associated basket in order to prevent its motion with respect to the brace.

3. The support rail and ironing board combination as recited in claim 1 wherein said rail is notched to permit suspension of clothes hangers in such a manner that the clothes hangers are fixed in position.

4. The support rail and ironing board combination as recited in claim 1 wherein the means for repositioning said rail consists of two brackets attached one each to said ironing board side edges.

5. The support rail and ironing board combination as recited in claim 4 wherein a helical coiled spring located under the ironing board is attached between said brackets to fixedely fit them to said ironing board side edges.

* * * * *